US006894621B2

(12) United States Patent
Shaw

(10) Patent No.: US 6,894,621 B2
(45) Date of Patent: May 17, 2005

(54) CRANE SAFETY DEVICES AND METHODS

(76) Inventor: Jack B. Shaw, 2710 Bedford St., Johnstown, PA (US) 15904

( * ) Notice: Subject to any disclaimer, the term of this patent is extended or adjusted under 35 U.S.C. 154(b) by 83 days.

(21) Appl. No.: 10/377,298

(22) Filed: Feb. 28, 2003

(65) Prior Publication Data

US 2003/0214415 A1 Nov. 20, 2003

Related U.S. Application Data

(63) Continuation-in-part of application No. 09/383,192, filed on Aug. 26, 1999, now Pat. No. 6,549,139, which is a continuation of application No. PCT/US98/03482, filed on Feb. 26, 1998, which is a continuation-in-part of application No. 09/030,249, filed on Feb. 25, 1998, now Pat. No. 6,140,930.

(60) Provisional application No. 60/039,825, filed on Feb. 27, 1997.

(51) Int. Cl.[7] ..... G08B 21/00

(52) U.S. Cl. ..... 340/685; 212/276; 701/50

(58) Field of Search ..... 340/685, 669–671, 340/673, 677, 691.1, 692, 425.5, 431, 436, 438, 463, 467–468, 474; 212/276, 277, 279; 701/50

(56) References Cited

U.S. PATENT DOCUMENTS

| | | | |
|---|---|---|---|
| 3,693,360 | A | 9/1972 | Holder |
| 3,815,116 | A | 6/1974 | Fink |
| 3,823,395 | A | 7/1974 | Rigney et al. |
| 3,848,750 | A | 11/1974 | Hoge |
| 3,969,714 | A | 7/1976 | Greer |
| 4,178,591 | A | 12/1979 | Geppert |
| 4,183,708 | A | 1/1980 | Kuhbier et al. |
| 4,236,864 | A | 12/1980 | Couture et al. |
| 4,238,037 | A | 12/1980 | Azovtsev et al. |
| 4,281,342 | A | 7/1981 | Ueda |
| 4,300,134 | A | 11/1981 | Paciorek |

(Continued)

FOREIGN PATENT DOCUMENTS

| | | |
|---|---|---|
| EP | 0072567 A2 | 2/1983 |
| FR | 2343294 | 9/1977 |
| FR | 76 05946 | 9/1977 |
| JP | 58-42600 | 3/1983 |
| JP | 05-085250 | 4/1993 |
| JP | 07-81887 | 3/1995 |
| JP | 08-324965 | 12/1996 |
| NL | 8503113 | 6/1987 |
| SU | XP-002182910 | 8/1981 |
| WO | WO 98/55388 | 12/1998 |

OTHER PUBLICATIONS

U.S. Department of Labor, Occupational Safety and Health Administration. Regulations (Standards—29 CFR), Cranes and derricks–1917.45 (17 pages).

James R. Guenther, "Interpretation on standards for use of cranes during high wind condition," Mar. 26, 1985, OSHA Occupational Safety & Health Administration U.S. Department of Labor, pp. 1–4.

*Primary Examiner*—Toan N. Pham
(74) *Attorney, Agent, or Firm*—Banner & Witcoff, Ltd.

(57) ABSTRACT

An improved crane warning system that includes acceleration sensors, motion sensors, hydraulic sensors, remote communications and/or a camera. The crane warning system may include a crane warning device integrated into the device suspended from the crane.

9 Claims, 12 Drawing Sheets

U.S. PATENT DOCUMENTS 4,303,973 A 12/1981 Williamson, Jr. et al.
4,424,909 A 1/1984 Bergeron
4,454,757 A 6/1984 Weinstein et al.
4,516,117 A 5/1985 Couture et al.
4,735,526 A 4/1988 Kawagoe et al.
4,752,012 A 6/1988 Juergens
4,788,534 A 11/1988 Engelhardt
4,833,615 A 5/1989 Bitner et al.
4,849,778 A 7/1989 Samuelson
4,896,370 A 1/1990 Kasparian et al.
5,019,798 A 5/1991 Pherigo, Jr.
5,042,959 A 8/1991 Tadatsu
5,058,752 A 10/1991 Wacht et al.
5,067,013 A 11/1991 Lindholm et al.
5,089,972 A 2/1992 Nachman et al.
5,152,408 A 10/1992 Tax et al.
5,198,800 A 3/1993 Tozawa et al.
5,211,245 A 5/1993 Relyea et al.
5,217,126 A 6/1993 Hayashi et al.
5,220,499 A 6/1993 Kawamori
5,353,400 A 10/1994 Nigawara et al.
5,371,895 A 12/1994 Bristol
5,392,935 A 2/1995 Kazama et al.
5,400,246 A 3/1995 Wilson et al.
5,485,620 A 1/1996 Sadre et al.
5,504,880 A 4/1996 Hirosawa et al.
5,506,787 A 4/1996 Muhlfeld et al.
5,517,404 A 5/1996 Biber et al.
5,526,268 A 6/1996 Tkacs et al.
5,537,605 A 7/1996 Teece
5,539,650 A 7/1996 Hehl
5,594,858 A 1/1997 Blevins
5,646,343 A 7/1997 Pritchard
5,729,453 A 3/1998 Lee et al.
5,730,305 A * 3/1998 Ichiba et al. ..... 212/276
5,731,974 A 3/1998 Pietzsch et al.
5,823,370 A 10/1998 Ueda
6,102,373 A * 8/2000 Amsinger ..... 256/1
6,140,930 A * 10/2000 Shaw ..... 340/685
6,202,013 B1 * 3/2001 Anderson et al. ..... 701/50
6,343,703 B1 * 2/2002 Fleagle et al. ..... 212/281
6,549,139 B2 * 4/2003 Shaw, Jr. ..... 340/685
6,744,372 B1 * 6/2004 Shaw et al. ..... 340/685

* cited by examiner

CRANE SAFETY DEVICES AND METHODS

This application is a continuation-in-part application of U.S. patent application Ser. No. 09/383,192, entitled "Crane Safety Devices And Methods" filed Aug. 26, 1999, now U.S. Pat. No. 6,549,139, which in turn is a continuation application of International Application No. PCT/US98/03482, entitled "Crane Safety Devices And Methods," filed Feb. 26, 1998, which in turn was a continuation-in-part application of U.S. patent application Ser. No. 09/030,249, filed on Feb. 25, 1998, now U.S. Pat. No. 6,140,930 (and which issued on Oct. 31, 2000 as U.S. Patent and Trademark Office) which in turn was based on U.S. Provisional Patent Application No. 60/039,825 entitled "Crane Safety Devices And Methods," filed Feb. 27, 1997, now abandoned, each of which applications are hereby expressly incorporated herein by reference in their entireties. In addition, copending U.S. patent application Ser. No. 09/447,812, entitled "Crane Safety Devices And Methods" filed Nov. 23, 1999, is hereby expressly incorporated herein by reference as well.

FIELD OF THE INVENTION

The present invention relates to crane safety methods and devices and, in particular, to improved safety devices and methods which warn workers of the movement of portions of a crane and otherwise assist a crane operator in safe operation of a crane.

BACKGROUND OF THE INVENTION

Conventional crane safety devices (such as, for example, those shown in U.S. Pat. No. 5,019,798) are subject to a number of deficiencies. For example, these devices must be manually attached to the load each time that a new load is secured to the crane. Further, if there is a warning beacon on the safety device, then the beacon often becomes obscured by the load, especially where the load is large or of an unusual shape. Further, the warning indicators on conventional warning devices are always active whether or not the load is actually in motion. This condition is dangerous because it does not sufficiently warn the workman when the crane is in motion. Because of these disadvantages, crane safety devices mounted proximate to the moving crane parts have not been widely utilized. Accordingly, there is a need for an improved crane safety device.

BRIEF SUMMARY OF THE INVENTION

One aspect of the invention is to provide an acceleration sensor within the crane warning device which activates the crane warning device whenever a device suspended from the crane is being accelerated in any direction. For example, a mercury switch, a piezo-electric sensor, or other conventional acceleration sensor may be utilized to determine when a device suspended from the crane is accelerating.

Another aspect of the invention is to include a sensor which detects constant velocity motion of a device suspended from the crane. This sensor may be utilized in addition to or instead of the acceleration detector coupled to the device suspended from the crane. The motion sensor may be wholly contained within a housing of the warning device or it may be distributed at other locations in the crane such as by coupling portions of the warning device to one or more other electromechanical components of the crane. In one aspect of the invention, portions of the motion sensor are coupled to one or more hydraulic systems in the crane and actuated appropriately whenever the hydraulic system is actuated to move the device suspended from the crane. In yet other aspects of the invention, portions of the motions sensor are coupled to the electronic control system of the crane. In still other aspects of the invention, the mechanisms for detecting motion are mounted remotely and communicate with the warning device using electromagnetic waves such as radio waves.

In yet other aspects of the invention, fail-safe mechanisms may be built into the crane warning device such that the warning device is activated whenever a sensor fails or looses contact (e.g., radio contact) with the warning device. Further, a crane warning device status monitor may be built into the cabin of the crane so that the operator may be warned of any operational problems with any of the sensors in a timely fashion.

In still further aspects of the invention, the crane warning device may be mounted to maximize its utilization and resulting safety such as by integrating the crane warning device directly into the device suspended from the crane. In still further aspects, the warning device may be removably or fixedly attached to the side of the crane (e.g., by bolting or magnetically attaching the device to one or more sides of the counter weight).

In still further aspects of the invention, multiple crane warning devices are coupled to the crane in different locations so as to maximize safety. For example, one crane warning device may be located on the suspended device, and second, third, and/or fourth crane warning devices respectively mounted on first, second, and third sides of the crane counter weight.

With some embodiments of the invention, a crane warning device may have audible alarms, visual alarms or both. For example, a warning device according to some embodiments of the invention may produce an audible alarm signal when the crane is moving. These embodiments might additionally permit a crane operator, a workman or both, to turn down or mute the alarm in order to allow better communication between the workman and the operator. Additionally, in other aspects of the invention, electronics in the warning device may electronically filter the noise from the crane audible warning device so as not to interfere with normal communication with the crane operator. The filtering eliminates the beeping emitted from the warning device Without filtering out the normal voice of the operator and/or worker. Still further, the pitch or sound of the audible alarm may change depending upon the direction and/or speed of the crane's movement, so that a workman can readily ascertain the direction and/or speed of the crane's movement without needing to actually look up at the crane. Still further, the volume of the audible alarm may increase as the block, hook or ball (or other device suspended from the crane) approaches the ground or other surface where workmen are present.

Still other embodiments of the invention may provide a visual alarm when the crane is moving. For example, some embodiments of the invention may have a downward pointing strobe light that flashes when the crane is moving. If the crane warning device is used with a personnel basket, then the strobe light may be mounted in the basket, on an interior wall of the basket, or on the railing of the basket. The visible alarm may also vary to indicate the direction and/or speed of the crane's movement. With some embodiments of the invention, a light source for generating the visible warning signal may be located with workmen working with the crane. The light source may be located, for example, in a helmet that can be worn by a workman, or in a portable device that can be carried by a workman. In yet other aspects of the invention, one or more crane warning devices that produce both a visual alarm signal and an audible alarm signal when the crane is moving may synchronize the signals so that the "beep" noise and/or the strobe light from all of the crane warning devices are coincident.

In still further aspects of the invention, a microphone and speaker system is included in the crane warning device such that the operator can communicate with the workers. For example, some embodiments of the invention may provide a two-way communication device that allows a crane's operator and a workman working on the ground to converse regarding the operation of the crane. Worker safety is vastly increased because the worker may use both hands to manipulate the load while verbally signaling the operator. Accordingly, the controls for the communication system may be "hands free" controls, allowing the crane operator and/or the workmen to communicate without having to manipulate the communication system. Still further, the communication system may employ noise canceling or noise reduction technology to minimize background noise, such as noise from the crane's engine. According to various embodiments of the invention, the communication system may be wireless. For example, the communication system may employ low electromagnetic frequencies that can penetrate building and rock. Alternately, various embodiments of the invention may locate the antenna for the crane operator's communication terminal at the end of the crane's boom, to facilitate communication with a communication terminal carried by one or more workmen. In still further aspects of the invention, the crane warning devices with communication devices are mounted on different sides of the crane so that the operator has immediate communications with all sides of the crane, further enhancing safety.

In further aspects of the invention, a camera may be mounted such that a "birds eye" view of the load and/or suspended device may be obtained by the operator sitting in the cab from a remotely mounted camera. The bird's eye view, alone or in conjunction with the audio communications, vastly increases safety and efficiency of the crane operating environment. With various embodiments of the invention, two or more cameras may be placed at different locations on the crane, such as along the jib, in order to provide the operator with a variety of viewpoints. Still further, one or more of the cameras may have auto-zooming capability, and/or allow the crane operator to control the camera or cameras to zoom in or out, thereby allowing the crane's operator to better view a desired crane operation. With some embodiments of the invention, the monitor for displaying the images taken by the camera can be located within the crane's cab. More particularly, the monitor can be placed at a location that allows the crane operator to easily shift his or her attention from the monitor to the crane's windows. For example, the monitor may be placed on or near the floor of the cab, so that the operator can simultaneously view one or both sides of the crane when looking through the cab's windows. Alternately or additionally, the monitor may be placed at the ceiling of or towards the upper portion of the cab so that the cab operator can view the television screen when he or she leans back in the operator's seat.

Some embodiments of the invention may additionally or alternately provide a seat for the crane's operator that allows the operator to more safely control the operation of the crane. For example, some cranes allow the crane operator to tilt the operator's seat back so that the operator can see out of the top window of the crane to observer, e.g., an operator in a personnel basket suspended from the crane. Unfortunately, when the operator tilts the seat back, the operator often cannot reach the hand controls or the foot pedals for operating the crane. Some newer cranes allow the entire cab structure to tilt up, but this solution cannot be used with older cranes and tilting the entire cab is very costly. Accordingly, various embodiments of the invention may provide an operator's seat that moves forward and/or down toward the crane's controls or moves one or more of the controls with the seat when the operator tilts. Thus, the relative distance between the controls and the operator are maintained when the operator tilts the operator's seat backwards.

With still other embodiments of the invention, the controls of a crane are modified to improve the crane's safety. For example, many cranes have a shutdown system that shuts down the crane's operation when the crane is carrying 85% of its maximum load. The shutdown system may typically be overridden, however, by simply turning off a switch in the cab allowing the operator to carry loads beyond the 85% safety limit and go to the maximum extent or overextend the crane's load capability. Further, the shutdown system gives no warning to the operator when it has been overridden. Accordingly, various embodiments of the invention provide crane controls continually provide feedback to the operator when the shutdown system has been overridden during subsequent operation of the crane. For example, the controls may provide an audible and/or visual warning signal while the safety controls are overridden. The warning signal may further alert the operator as to how close the load of the crane is to its maximum limit. With still other embodiments of the invention, the crane controls may include one or more automatic shutoff buttons or switches that immediately halts all movement of the crane. These shutoff buttons or switches may, for example, be located in the crane's cab and/or on portable devices carried by workmen working with the crane.

Various embodiments of the invention may additionally provide a mechanism to prevent the ball of the crane (or other device or load suspended from the crane) from uncontrolled spinning or rotation. For example, some embodiments of the invention may provide a mechanism for locking, breaking and/or unbreaking the rotation capability of the ball. The mechanism may even include a motor for controlling the rotation of a suspended device. The mechanism may be controlled from the suspended device or other load, such as when the suspended device is a personnel basket, or alternately or additionally controlled from the crane's cab.

DETAILED DESCRIPTION OF THE INVENTION

Crane Warning Devices

Figure 1:
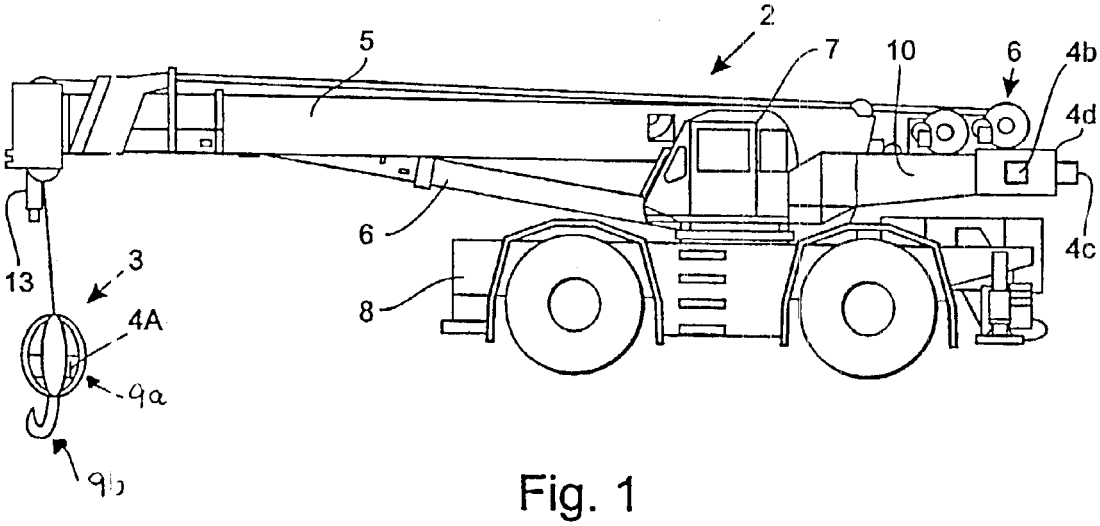
FIG. 1 is a perspective view of a crane incorporating aspects of the crane warning system.
Figure 2:
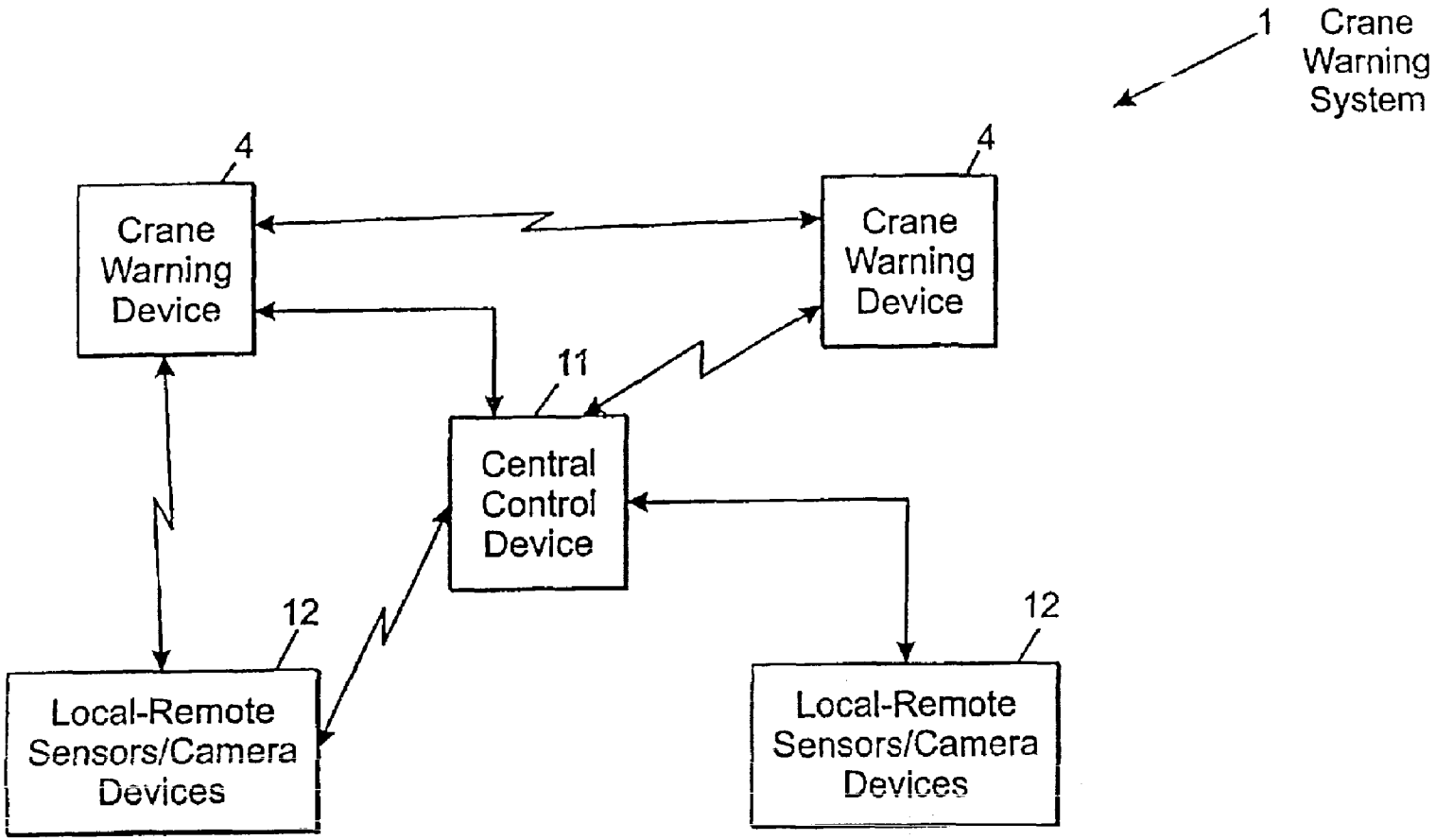
FIG. 2 is a block diagram of a crane warning system incorporating a plurality of crane warning devices, a central control device, and a plurality of remote sensors.

Referring to FIGS. 1 and 2, a crane warning system is incorporated in a crane 2 to improve the safety of workers (not shown) in the vicinity of the crane. The crane 2 typically includes a boom 5, various movement mechanisms 6 to move the boom 5, carriage (not shown in the embodiment of FIG. 1), and a device 3 suspended from the boom 5 in any one of a plurality of direction. In the illustrated embodiment, the suspended device 3 is a ball 9*a* with a hook 9*b*. With alternate embodiments of the invention, however, the suspended device 3 may be a single hook, a block (e.g., as part of a block and tackle combination), a personnel basket, an electromagnet, a wrecking ball, or any other device that may be suspended from a crane's boom for a desired crane configuration. As will be appreciated by those of ordinary skill in the art, multiple devices 3 may be suspended from a crane 2. For example, a particular crane configuration may have both a ball and a personnel basket suspended from the boom 5.

The movement mechanisms of the crane 2 may include any hydraulic, electromotive, mechanical and/or other mechanisms well known in the art to cause motion of the suspended device 3, boom 5, and/or carriage (not shown). For the purposes of this specification, the boom 5 includes any jib or other extension which may be attached to the boom 5. The crane 2 typically includes a cab 7 for accommodating an operator (not shown). In many cases, the cab 7 is either partially or completely enclosed to provide a controlled environment for the operator. The crane 2 may include one or more crane warning devices 4 strategically disposed about the crane 2. In the embodiment shown in FIG. 1, the crane warning device 4*a* is incorporated directly into the device 3 suspended from the crane 2. Alternatively, the crane warning device 4 may be located at other strategic locations such as on the counter weight 10. In the embodiment illustrated in FIG. 1, there are three crane warning devices 4*b* located on three different sides of the counter weight 10.

Disposing a crane warning device 4*b* on the crane counter weight 10 is particularly advantageous where the crane 2 is used in an urban area. Often the crane 2 is positioned in the street adjacent to the sidewalk. Pedestrians are often routed around the crane 2 using orange warning cones. However, in order to keep from being injured by cars, pedestrians often stand within the cones while waiting for cars to pass. These pedestrians are often oblivious to the fact that when the crane 2 turns, the large counter weight 10 also swings out into the street where they are standing. Thus, the crane warning devices 4*b* disposed on the counter weight 10 are particularly advantageous. The crane warning device 4*b* may be located directly on the counter weight 10 using any suitable method, such as bolting, strapping, or magnetic attachment. The crane warning device 4*b* may also be mounted toward the back of the counter weight 10 so as to be near the portion of the counter weight 10 that extends furthermost from the crane 2 as the counter weight 10 turns.

Referring now to FIG. 2, one or more of the crane warning devices 4 may operate in isolation or may be coupled to one or more other devices. Where the crane warning devices 4 are coupled to other devices, they may be coupled to a central control device 11, one or more other crane warning devices 4, and/or one or more remote sensors/camera units 12. Where a central control device 11 is utilized, the central control device 11 may be directly or indirectly coupled to one or more remote sensors and/or camera units 12. The connections between the crane warning devices 4, the central control device 11, and remote sensors and/or camera units 12 may be accomplished using any suitable mechanism such as electromagnetic transmission (e.g., radio waves) and/or direct electrical and/or optical connections.

A crane warning device 4 may employ wireless communication between a remote sensor or camera unit 12 and the central control device 11. In some embodiments that use wireless communication, the wireless communication link is configured to avoid interference from buildings, hoisted equipment or other obstructions. Interference with the wireless connection is a safety concern, as the operator might assume that the crane warning device 4 is properly working, and might not know if the crane warning device 4 has failed when it moves behind a stone tower or other obstruction and loses communication with the control device 11. Accordingly, with some embodiments of the invention, if the control device 11 is positioned on the main portion of the crane 2 (for example, in or on the cab 7 or on the boom 5), then an antenna of the communication unit for the control device 11 may be placed at or toward the end of the boom 5. Alternately or additionally, the wireless communication link may be made with a lower frequency communications system that can penetrate rock, stone or other desired material to enable consistent and reliable communication between the main portion of the crane 2 and the crane warning device 4.

Various embodiments of the invention may further activate an audible and/or visible warning signal when a crane warning device 4 loses communication (wireless or otherwise) with the control device 11. The warning signal may be generated for any desired person working with the crane, including the crane operator, persons working in a personnel basket suspended from the crane, and workmen working around the load of the crane.

As previously noted, various embodiments of the crane warning device 4 may employ a remote camera 12 that allows the crane operator to view the area around the crane's load. Although standardized hand signals are typically employed to communicate between the crane operator and workmen working with the crane load, the hand signals cannot be seen when the operator is in a blind situation (e.g., when the line-of-sight between the operator and the workmen is obstructed). Thus, a remote camera 12 mounted on the boom 5, for example, which views the location of the load can be used by the operator to control the load when the operator cannot otherwise see a workman's hand signals.

Where a remote camera 12 is utilized, the remote camera 12 may be mounted in any suitable location such as on the boom 5, suspended device 3, cable, carriage, etc. In many embodiments, the remote camera 12 may be mounted such that a bird's eye view is presented to the operator in the cab 7 such that the operator can see all around the load and is not restricted to viewing only one side of the load. In this manner, when the worker stands on the far side of the load, the operator can view the worker's actions and position relative to the load. Some embodiments of the invention may employ multiple cameras 12 placed at different locations on the crane 2. For example, the telescoping boom 5 of the crane 2 includes a number of couplings along its length that can accommodate equipment bolted to the couplings. Multiple cameras 12 may thus be mounted along these couplings so that the operator (or the control unit 11) may select any one of the cameras 12 for imaging, depending on the position of the load. If a personnel basket is being used with the crane 2, then one or more of the cameras 12 may be mounted on another device 3 suspended from the crane 2, such as a ball 9*a*, instead of the basket in order to provide more stable images. A personnel basket may be violently moved or spun by the wind, while, for example, a headache ball 9*a* typically is not as easily affected by the wind. These cameras 12 may placed on the ball 9*a* where they are not obscured by the cables or chains suspending the basket from the ball 9*a*. Also, if the ball 9*a* is split into two portions such that one portion rotates and the other portion does not rotate, then the camera or cameras 12 may be mounted on the non-rotating portion to provide a steady image.

It should be noted, however, that the view out of the top or bottom of the crane 160 feet or more down/up may not be particularly good, depending upon the operator's vision and prevailing weather conditions. Accordingly, various embodiments of the invention may use one or more cameras 12 equipped with focusing and/or magnification capabilities (e.g., with a telephoto lens). For example, one or more cameras 12 may each be equipped with a zoom lens to zoom-in on the work area which may be either remote controlled and/or controlled based on the current location of the suspended device 3. In other words, the zoom lens may be adjusted such that the zoom feature tracks the current location of the suspended device 3 with little zoom where the suspended device 3 is close to the boom 5 and increased zoom where the suspended device 3 is remote from the boom 5. The focusing and/or magnification capabilities may also be controlled by the crane operator in the cab 7, a basket operator in a personnel basket, or a combination of both. Further, automatic exposure adjustment may also be employed, to maintain picture quality when the operator's view of the load is directly into the sun.

The remote camera or cameras 12 may also be equipped with a laser range finder which determines the location of the ground level relative to the boom 5 and relays this information back to a central controller that controls movement of the suspended device 3. The controller may cause the raising and lowering of the suspended device 3 to be at a rapid rate until the suspended device 3 approaches the ground or target level and then automatically slows the suspended device's descent. Similarly, the range finder may be positioned directly over the suspended device 3 and be directed at the suspended device 3, while a second range finder is directed to the side of the suspended device 3 at the ground or target location so that the controller is able to determine the relative distance between the suspended device 3 and the ground or target location.

With still other embodiments of the invention, one or more cameras 12 may be provided in or around the cab 7, with the images being displayed to workmen working around the crane's load, workmen working in a personnel basket suspended from the crane 2, or both. This arrangement conveniently allows the crane operator and, for example, an operator in the personnel basket to make eye contact so that the operator in the basket can be assured that the crane operator in the cab 7 is paying attention to the basket operator's instructions. Thus, even when the basket is in a blind situation (i.e., when the crane operator cannot see the operator in the basket and/or near the load), the crane operator can still receive instructions from the basket operator or workmen. Similarly, the person near the load/basket can monitor the crane operator's status.

With these embodiments of the invention, the workmen on the ground or in the personnel basket may view the images from the cab 7 on any type of suitable display monitor. For example, a workman may view the images from a display monitor that does not interfere with the use of the workman's hands, such as a heads-up display mounted on a workman's helmet or belt, a projection eyewear display, and/or watch-mounted display screen. Of course, audio communication between the cab 7 and the workmen can be used in conjunction with the visual link between the cab 7 and the workmen, as will be discussed in more detail below. Where a wrist mounted or belt mounted monitor is utilized, it may be desirable to include the audio communication device directly into the monitor. In this manner, the individual proximate to the load can have two-way video conference capability and still have his/her hands free to work with the crane's load.

Figure 4:
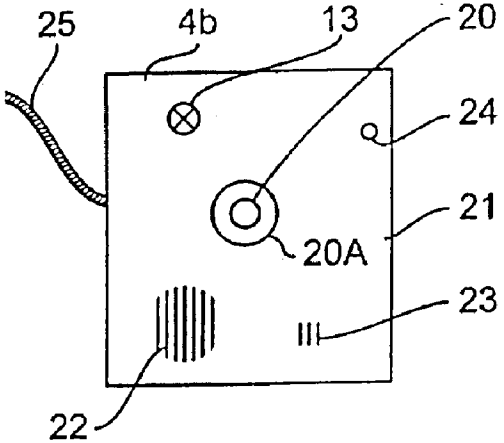
FIGS. 3–7 are perspective views of first, second, third and fourth embodiments of a crane warning devices incorporating aspects of the present inventions.
Figure 3:
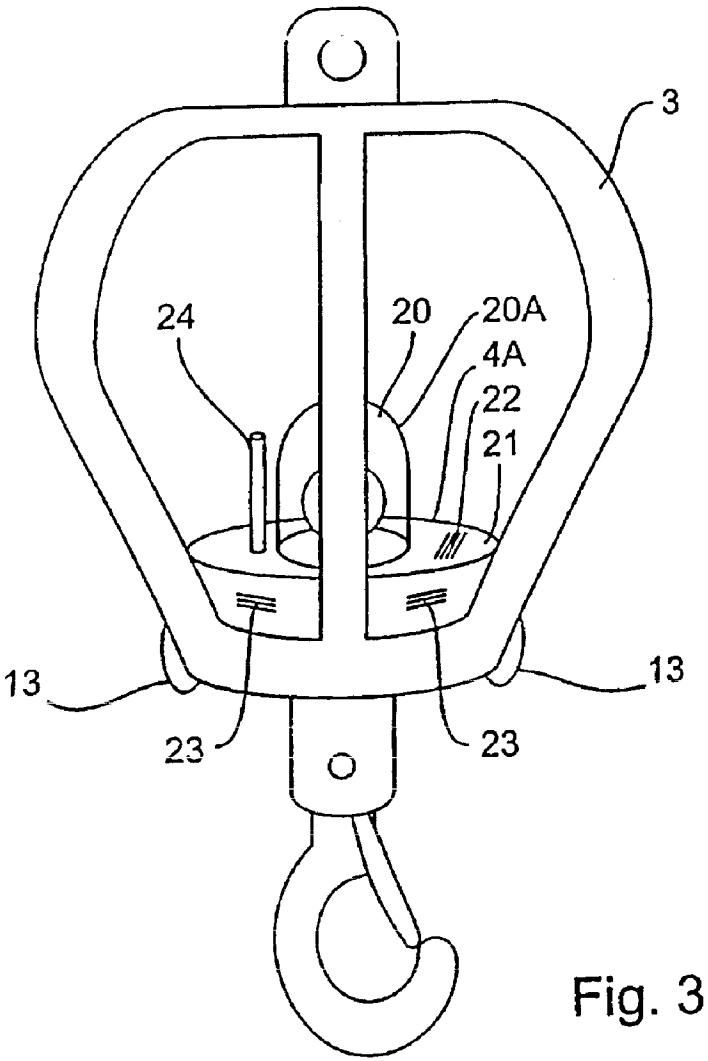
Figure 5:
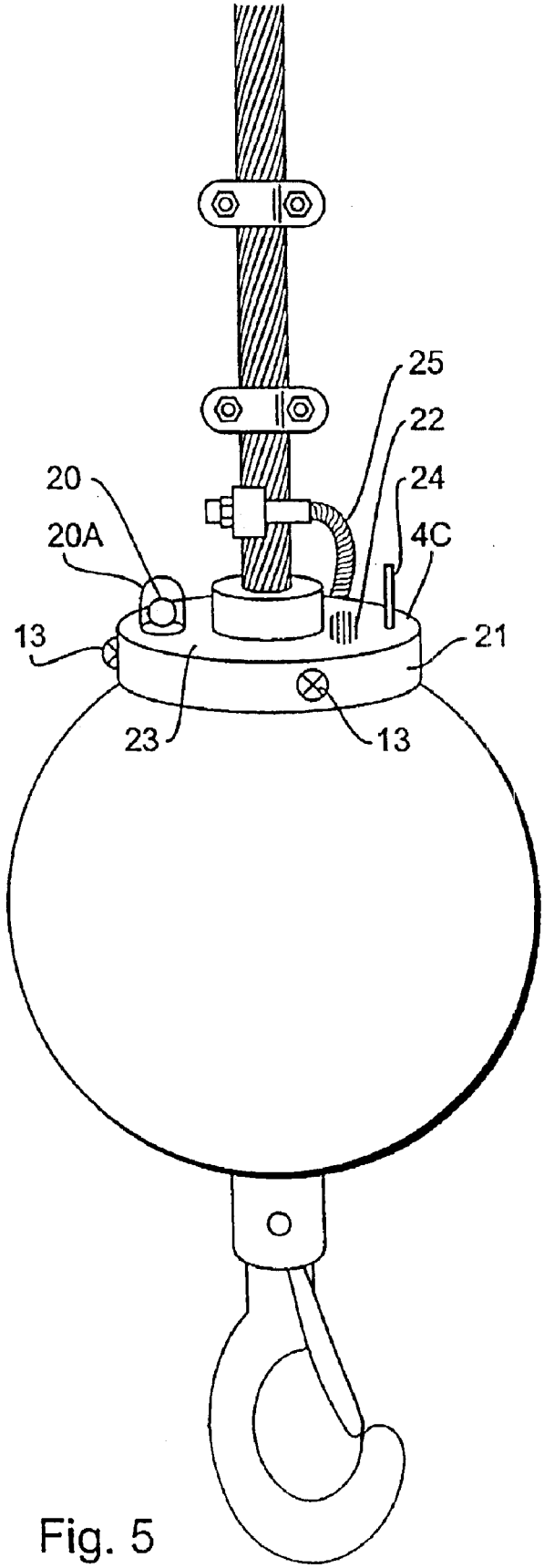

Many crane cabs are equipped with windshield wipers and are operated in all environments, including rain. Thus, various embodiments of the invention may have cameras 12 that are environmentally sealed and provided with a defroster and/or a rain shield, so that the visibility of the cameras will not be obscured in inclement weather Referring to FIGS. 3–7, five different embodiments of the crane warning device 4 are shown. The crane warning devices 4A, 4B, and 4C may include a beacon light 20, one or more audible warning devices 22 (speakers), one or more audio processor devices 23 (microphones), a transmit/receive mechanism 25 (antenna), a tether 24, and/or one or more remote sensor/camera devices 13 coupled to an enclosure 21. With regard to FIG. 3, the crane warning device 4A is incorporated directly into a device 3 to be suspended from the crane 2. Where the crane warning device is integrated into the suspended device 3 of the crane 2, visibility of the warning light is maximized and a centralized audible warning noise is advantageously provided to minimize interference of the load with the warning device. When integrated into the suspended device 3, the warning device remains visible from substantially all angles, e.g., 360 degrees. With regard to FIG. 4, the crane warning device 4 may be incorporated in an enclosure 21 and mounted about the crane 2 such as on one or more sides of the counterweight 10. In the embodiment of FIG. 5, the crane warning device may be positioned above the suspended device 3. In the embodiments of FIGS. 4 and 5, it may be desirable to incorporate a magnet into the base of the crane warning device 4 to facilitate attachment to the suspended device 3 or counterweight 10 of the crane 2. In this manner, it is a simple task to retrofit cranes with a suitable crane warning device 4.

Figure 6:
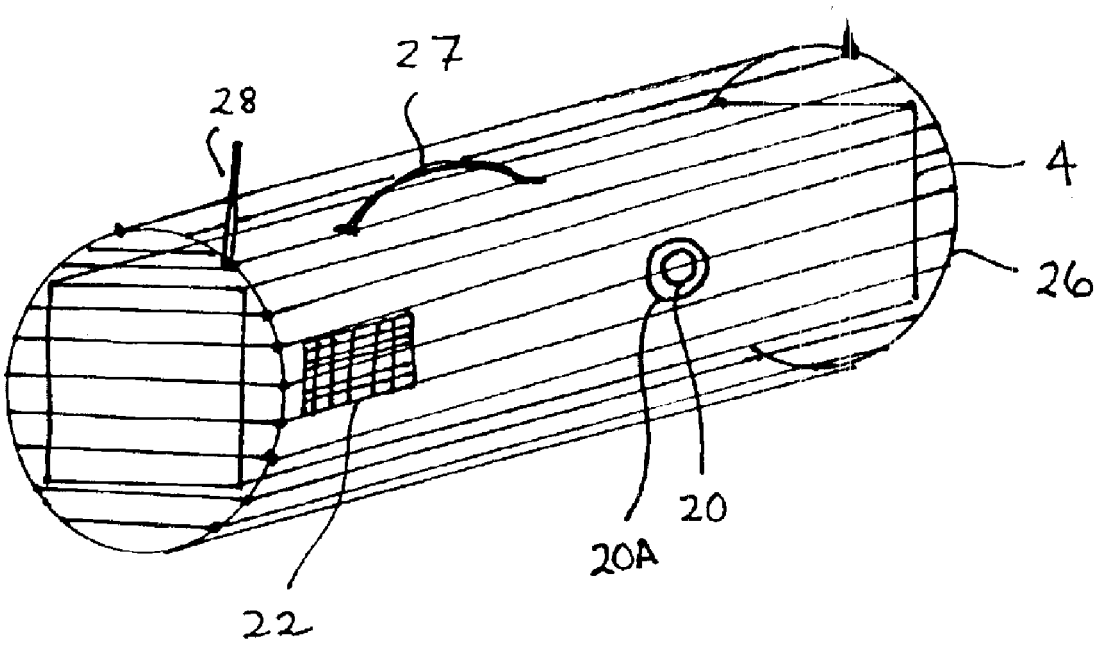

As shown in FIG. 6, the crane warning device 4 may also be of solid construction and enclosed in a protective shield or cage 26. As will be appreciated by those of ordinary skill in the art, placing the crane warning device 4 in the protective shield or cage 26 increases the long-term survival rate of the crane warning device. The crane warning device 4 may be made of a low cost plastic and/or metal structure, while the cage 26 may be made of steel. The steel cage 26 may then be bolted on the suspended device 3 or a location proximate to the suspended device 3. Thus, the crane warning device could be easily removed for servicing and/or battery replacement. When removed from the protective cage, the device is thus light and easily handled. As shown in FIG. 6, the crane warning device 4 has a handle 27 to facilitate carrying. As also seen in this figure, the crane warning device 4 has a wireless antenna 28 for wirelessly communicating with the crane operator in the cab 7. With the embodiment illustrated in FIG. 7, the crane warning device 4 is mounted to the suspended device 3 (in the illustrated embodiment, a ball 9*a*) by way of a mount 29. As seen in this figure, the mount 29 is attached to the ball 9*a* through a connecting pin connecting the ball 9*a* to the chain or cable suspending the ball 9*a*.

While each of the crane warning devices 4 described above are part of a single unit, it should be noted that, with other embodiments of the invention, one or more components of the crane warning device 4 may be separately located. For example, with some embodiments of the invention, the beacon light 20 may be connected by wire or wirelessly connected to the crane warning device 4 so that it can be positioned at a different location than, for example, the audible warning device 22 and/or microphone 23.

Where strong sunlight might interfere with the signal from the beacon light 20, it may be desirable to locate the beacon light 20 so that it is more apparent to workmen working around the load or in a personnel basket. For example, if the crane warning device 4 is being used with a load, the beacon light 20 may be directed toward the workers associated with the load. When the load is beneath the suspended device 3, the beacon light 20 may be directed downward. This may be particularly beneficial when the suspended device 3 is suspended more than 6 to 8 feet over the workmen's heads. Still further, if crane warning device 4 is used with a personnel basket, then it may be desirable to mount the beacon light 20 in the basket, so that the basket does not obscure the beacon light 20 from the view of basket operator. For example, the beacon light 20 may be mounted on the interior walls of the basket, or in the railing of the basket. With some embodiments of the invention, a second beacon light 20 may be placed on the outside of the basket as well, so that the signal from the second beacon 20 may be seen by workmen working below the basket.

Figure 8:
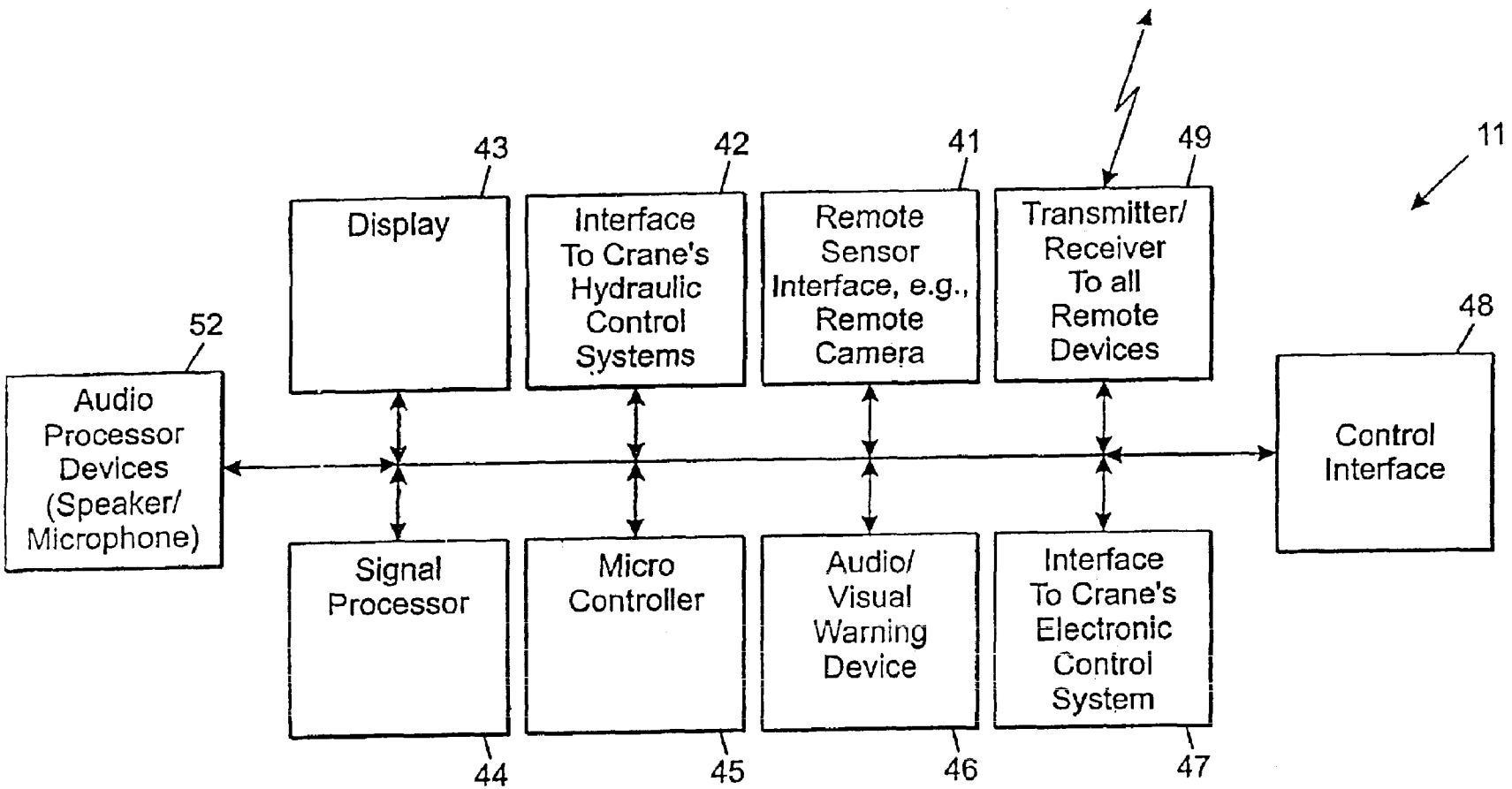
FIG. 8 is a block diagram of an embodiment of the crane warning device.
Figure 9:
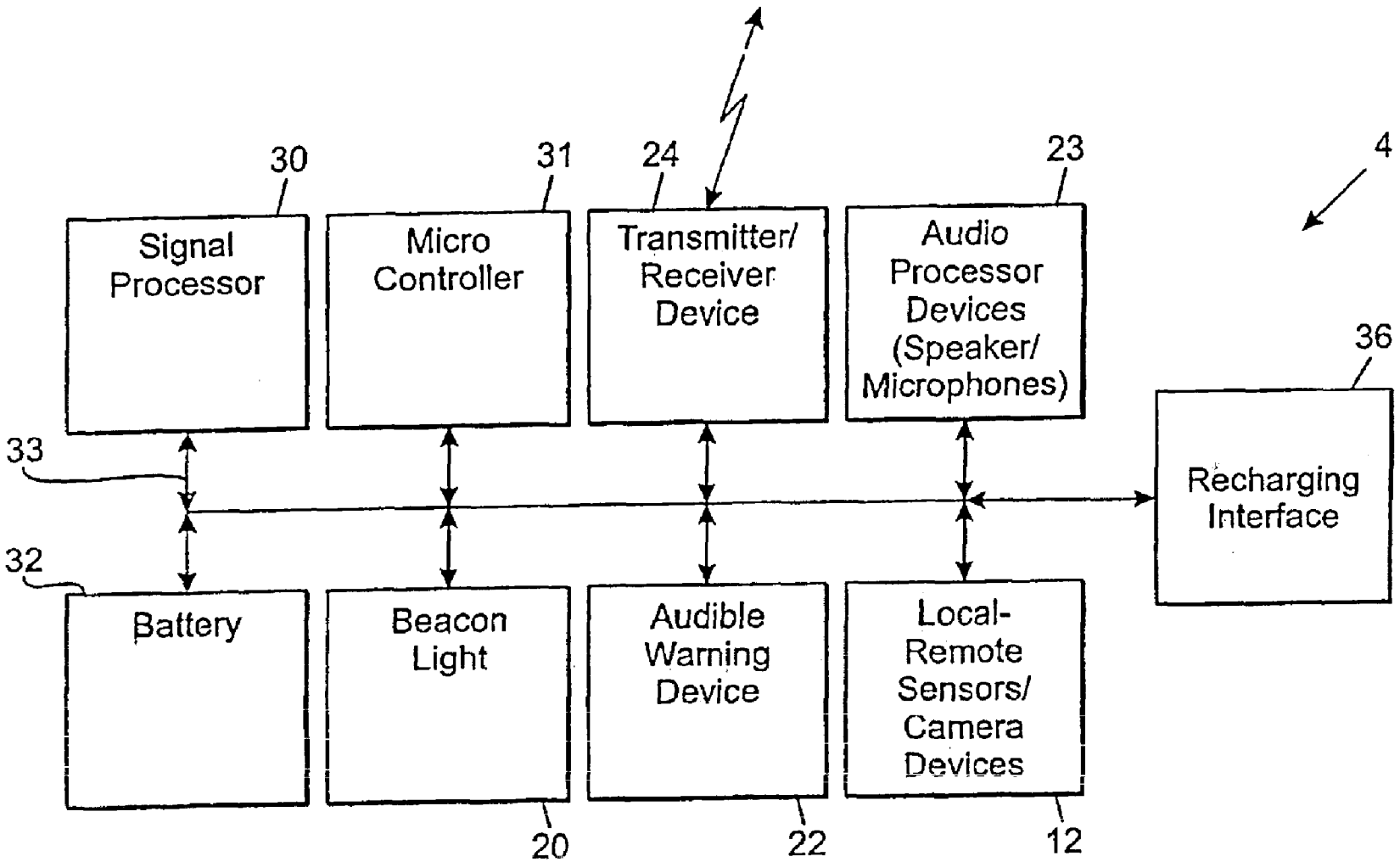
FIG. 9 is a block diagram of a central control device.

Referring to FIG. 8, an exemplary block diagram of one embodiment of the crane warning device 4 is shown. The crane warning device 4 may include the beacon light 20, the audible warning device 22, the local and/or remote sensors/camera device 12, audio processor devices 23, transmitter/receiver device 24, a signal processor 30, a microcontroller 31, a recharging interface 36, and a battery 32 interconnected via one or more system busses 33. FIG. 9 shows an exemplary block diagram of one embodiment of the central control device 11. The central control device 11 may include a signal processor 44, a microcontroller 45, an audio/visual warning device 46, an interface to the crane's electronic control system 47, a control interface 48, a transmitter/receiver 49, a remote sensor interface 41, a hydraulic control interface 42, and a display 43.

Figure 10:
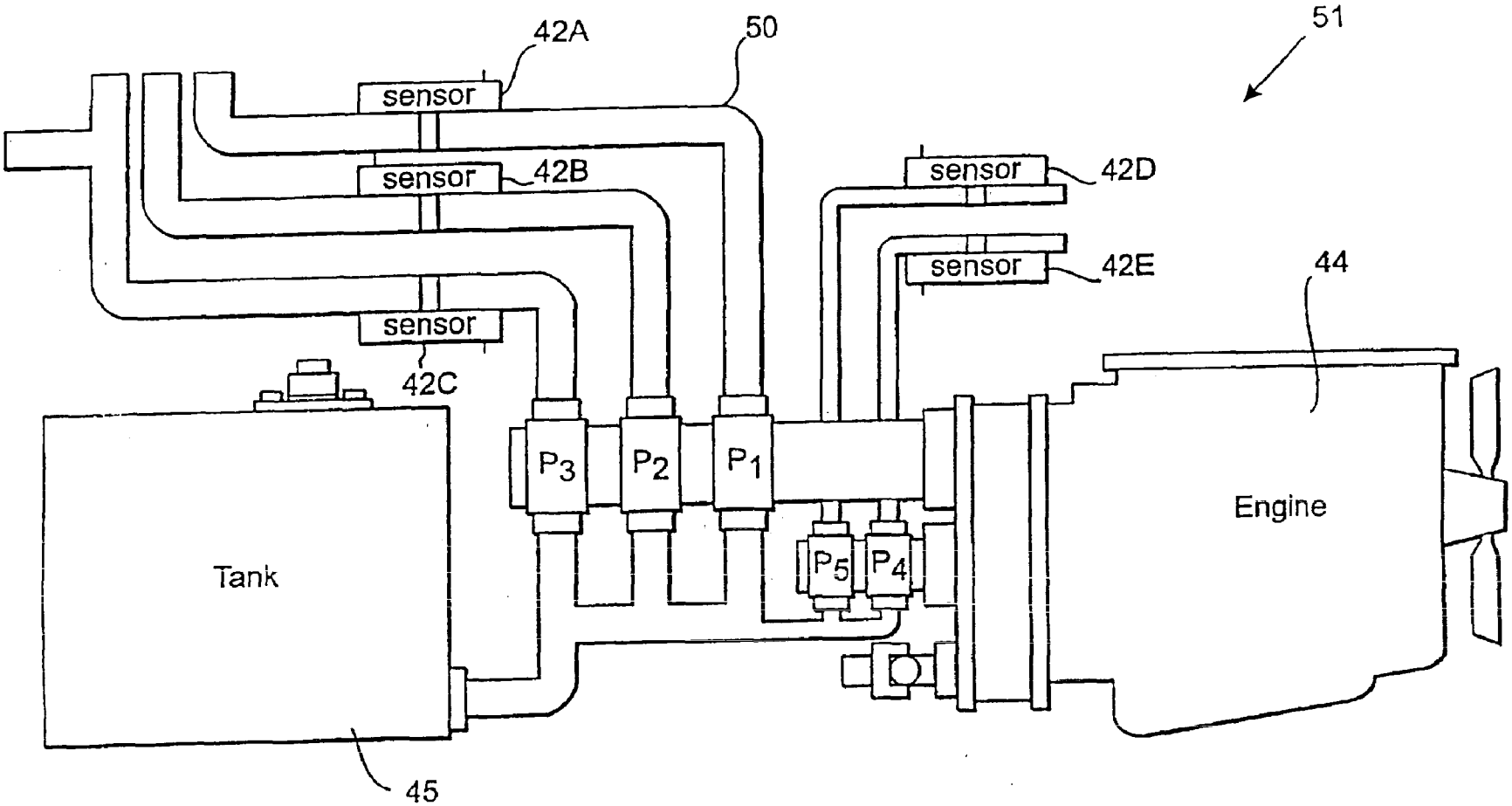
FIG. 10 is a partial schematic, partial block diagram of a remote sensor arrangement coupled to a hydraulic system in the crane.

FIG. 10 shows an exemplary embodiment of the hydraulic system 51 of the crane 2 where hydraulic sensors 42A–42E are coupled to a hydraulic system incorporating a tank 45, a plurality of pumps P1–P6, an engine 44, and a plurality of hydraulic lines 50. With this arrangement, the crane warning device 4 (through one or more of the hydraulic sensors 42A–42E) can determine when and/or how the suspended device 3 is moving by detecting the actions of the crane's hydraulic system 51. Alternately or additionally, the crane warning device 4 may include electronic system sensors (not shown) for detecting the actions of the crane's electronic system. Using these sensors to detect actuation of controls by the crane operator, the crane warning device 4 may thus be able determine that the suspended device 3 is going to move and in what direction even before the suspended device 3 actually begins to move. The crane warning devices 4 and the central control device 11 may be variously configured to include any subset of the devices shown in the block diagrams or FIGS. 1–9 in any subcombination.

The beacon light 20 may be any suitable configuration including a flashing light or a strobe light. In some embodiments, the beacon light 20 may include a protective cover 20A made of a high impact polymer such as a plastic resin. Further, the protective cover 20A or the beacon light 20 may be colored so as to emit a red or orange light. In preferred embodiments, the output of the beacon light 20 is controlled such that the beacon does not interfere with the vision of the workmen working in the vicinity of the suspended device 3. This may be done by using a colored protective cover. In one exemplary embodiment, the light output is similar to a battery operated road-side flasher.

With still other embodiments of the invention, the beacon light 20 may be made up of a plurality of different individual lights. The lights may be of any desirable manufacture, including incandescent lights, fluorescent lights, or light emitting diodes. The lights may all be of a single color, or they may have different colors. Further, with some embodiments of the invention, the lights can be actuated to indicate the direction and/or speed of the movement of the suspended device 3. For example, if the crane warning device 4 detects that the suspended device 3 is moving to the left, then a light emitting diode indicating leftward movement may be activated (e.g., may begin blinking) in response. Moreover, the light emitting diode could be oscillated at a rate corresponding to the speed of movement of the suspended device 3. With still other embodiments of the invention, a beacon light 20 (or row of lights making up a beacon light 20) may be positioned on each side of the suspended device 3. When the suspended device 3 begins moving, the crane warning device 4 could then activate the beacon light 20 facing the direction of movement, so that individual in a personnel basket and/or working with a load may have instantaneous feedback as to the motion of the suspended device 3. Alternately or additionally, a crane warning device 4 may have beacon light 20 to indicate when the suspended device 3 is rotating, moving up, and/or moving down.

Figure 11:
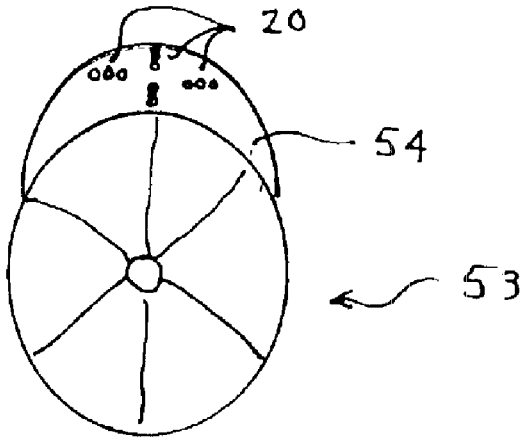
FIG. 11 is a planar view of a helmet incorporating portions of a crane warning device according to various embodiments of the invention.
Figure 7:
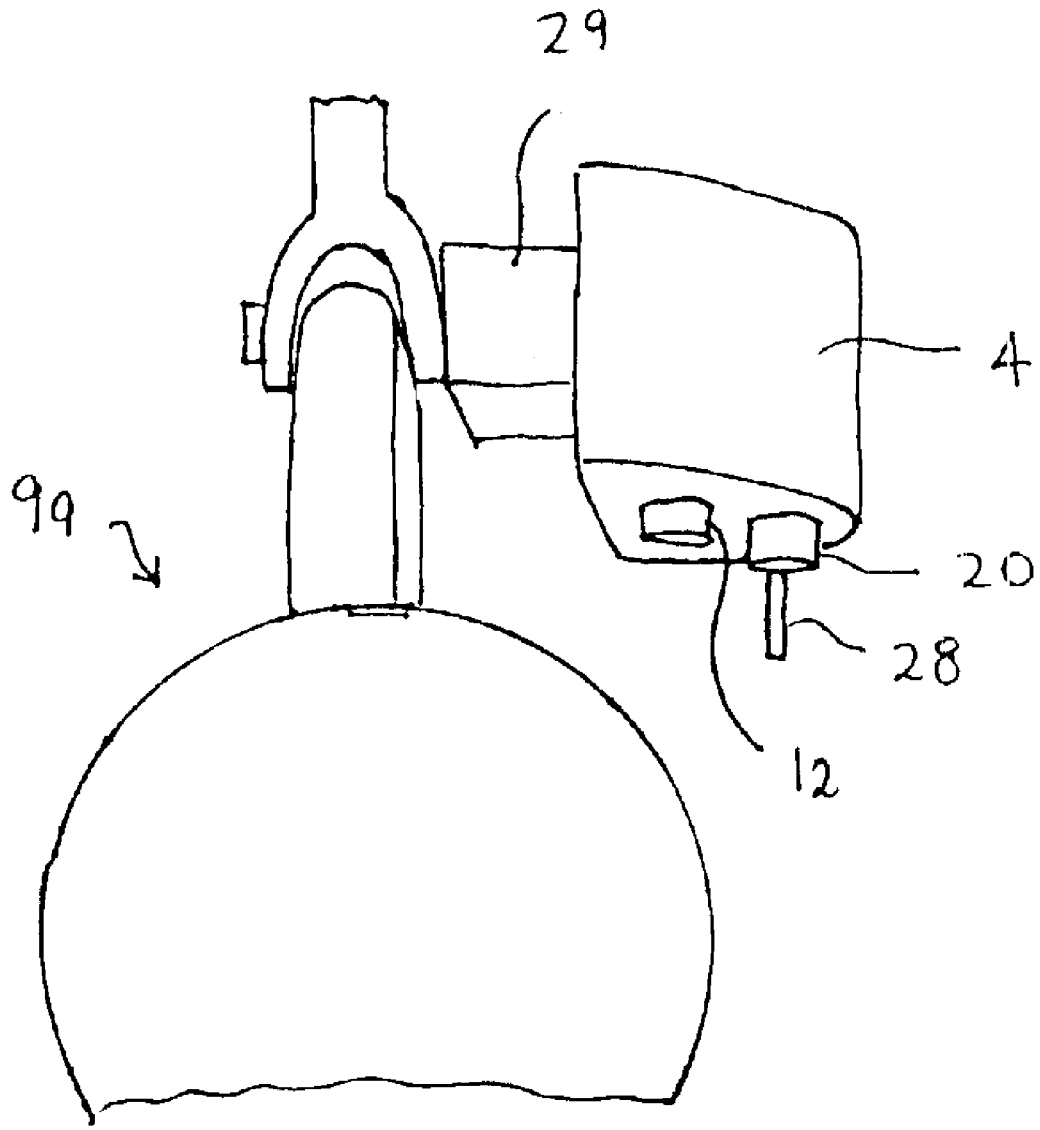

In still further embodiments of the invention, movement of the suspended device 3 (or a load) may be indicated by a beacon 20 carried by a worker working around the suspended device 3 or load. Workmen working on the ground or at a target level may thus have a beacon light 20 carried in a belt or mounted in a helmet. For example, a workman may employ the helmet 53 shown in FIG. 11. As seen in this figure, the helmet 53 includes multiple beacons 20 (each beacon 20 being made up of a group of light emitting diodes) on the visor 54. Each beacon 20 can be actuated by the crane warning device 4 to indicate to the wearer movement of the suspended device 3, speed of movement of the suspended device 3, direction of movement of the suspended device 3, or any combination of the three. With some embodiments of the invention that track the location of the suspended device 3, the beacon 20 may even be actuated to indicate the proximity of the suspended device 3 to a workman carrying the beacon 20. The two-way video conference display discussed herein may also be mounted on the safety helmet 53.

Turning now to the audible warning alarm, the audible warning device 22 may be variously configured to produce any desired audible warning signal, such as the audible warning signal commonly associated with backing movement of a truck. It may be desirable to maintain the volume of the audible sensor within a range which alerts the workman in the vicinity of the suspended device 3 to movement of the suspended device 3 but without interfering with normal communications of the workman. In other words, the workman should still be able to speak over the audible warning noise. To facilitate this objective, the beeping noise emitted by the audible warning device may be limited to occur at a rate of only once per second, or ever other second or every third second. Alternately, the crane warning device may allow a user to turn off the audible signal, turn down the volume of the audible signal, or both. With some embodiments of the invention, the volume or on/off control may remain in a set position until a user manually changes the status of the control. Alternately, the control may only temporarily mute or reduce the volume of the audible signal, and return the audible signal to its normal volume after a predetermined period of time.

With some embodiments of the invention, control over the activation and/or volume of the audible alarm signal may be exercised by the crane operator, a workman working with the load, a workmen working in a personnel basket, or any combination of the three. Further, the audible alarm may be automatically muted when communications between the crane operator and another workman is in progress. In this manner, detecting the communication transmission and/or talk button depression of a communication unit employed by the workman or the crane operator may temporarily mute the audible alarm. The communication unit may be an integral component of the crane warning device 4 (i.e., the audio processor 23), or it may be a separate communication device connected to the crane warning device (e.g., a general-purpose hand-held radio) for the purpose of controlling the operation of the audible alarm. As previously noted, a failsafe device may prevent the muting from lasting more than a predetermined period of time.

The audible warning noise may be emitted continuously at a particular frequency. With alternate embodiments of the invention, however, the sound emitted from the crane warning device 4 may change in frequency so that the audible alarm has a higher or lower frequency as the suspended device moves up, down, or horizontally. For example, if the audible alarm is a beeping noise, then the frequency of beeps may increase, the tone or pitch may increase, or both, as the suspended device 3 moves upward. Alternately or additionally, constant movements of the suspended device 3 may produce one tone or sound pattern, while acceleration of the suspended device 3 may produce another tone or sound pattern. For example, each movement direction engaged by the crane operator through operation of the controls (such as left, right, up or down) may be indicated by a different frequency in the audible alarm, so that a workman in a personnel basket or working around a load would have an immediate feedback as to the expected motion and acceleration of the suspended device 3. Further, different types of melodies or sounds could additionally or alternately be used to differentiate directions of movement of the suspended device 3.

Still further, because the audible alarm may become annoying if the suspended device 3 is steadily moving for a prolonged period of time, some embodiments of the invention may reduce the volume of the audible alarm after the suspended device 3 has been moving consistently, until the operator changes the movement direction or speed of the suspended device 3 again. This feature additionally helps the workmen from becoming complacent regarding the audible alarm. Alternately or additionally, some embodiments of the invention may provide a distinct audible alarm that is activated during special circumstances. For example, the warning device 4 may produce a high volume (and/or uniquely pitched) audible alarm when the crane operator initially activates the crane's controls to move the suspended device 3. After a short period of time to allow persons on the ground to prepare for the crane's movement, the crane 2 may then begin to move in response to the controls' activation. When the crane 2 actually starts to move, the warning device 4 may switch to a lower volume (or differently pitched) audible alarm for the duration of the crane's movement. Still further, the distinct audible alarm may be alternately or additionally activated manually by the crane operator or other workman. For example, the cab 7 may a manual control to activate a higher volume (or differently pitched) audible alarm. The crane operator can then activate this distinct audible alarm if, e.g., the operator sees someone in imminent danger of being struck by the suspended device 3.

It should be noted that, with some embodiments of the invention, the controls for the crane warning device 4 in the cab 7 (for, e.g., controlling the motion and/or zoom of the camera or cameras 12, controlling the volume of the audible alarm, etc.) are integrated into the crane controls. The arrangement allows the crane operator to better operate the crane warning device 4 while simultaneously operating the crane controls. Further, with some embodiments of the invention, the audio set/microphone 22 may be a two-way "hands free" device, so that the crane operator can more successfully have hands-free communication with workmen working in the personnel basket and/or near the load. With some embodiments of the invention, the crane warning device 4 may provide an emergency control button in the cab 7 of the crane 2 and/or on portable control units carried by the workmen that may be utilized to warn of the load approaching a person. The operator (or workman) can push the button in the event the load is dangerously close to an individual or to warn of danger. Activating the button may, for example, increase the volume of the audible alarm and/or change the frequency of the audible alarm.

The local and/or remote sensors/camera devices 12 may be variously configured. For example, the sensors may include any one of a number of local sensors or remote sensors. In one embodiment, one or more local acceleration sensors are included which detect acceleration of the suspended device 3 in any one of three dimensions. For example, a vertically and horizontally mounted acceleration sensor may be utilized. The acceleration detector may be any detector known in the art such as a piezoelectric sensor and/or a mercury based sensor. Of these, the piezoelectric based sensor may be more desirable due to the high impact environment often experienced by the suspended device 3.

Further, one or more sensors can be employed to detect the distance of the suspended device 3 from the ground. For example, a sensor within the crane's controls may monitor the relative position of the suspended device 3 to the ground. Alternately or additionally, one or more laser range finders may be incorporated into the remote sensors/camera devices 12. For example, a first laser range finder may be trained on and/or located within the suspended device 3 to determine the distance of the suspended device 3 from the boom 5. A second laser range finder may be located on the boom 5 and/or carriage and used to determine the distance from the boom 5 to the ground or target location where the suspended device 3 is suppose to be positioned above. The first laser range finder may be utilized by the central control device 11 to determine the rate of acceleration of the suspended device 3 toward the target such that the suspended device 3 may be accelerated relatively quickly while it is a great distance from the target and then slow as it approaches the target. In this manner, the overall efficiency of the crane operation may be improved without a decrease in safety. Additionally, the signal from the audible alarm and/or the visible alarm may change as the suspended device 3 gets close to the ground. For example, with some embodiments of the invention, the frequency or volume of the audible alarm will increase as the suspended device 3 gets closer to the ground or target level.

There is any number of degrees of freedom for the suspended device 3 of a crane 2 to move. The suspended device 3 may move at a constant velocity with no acceleration or with a variable or constant acceleration. For example, the suspended device 3 may move along the boom 5 on a carriage, or the suspended device 3 may move as a telescoping boom 5 extends or retracts. The suspended device 3 may also move as the boom 5 swings right or left or moves up or down. In other works, a suspended device 3 on a typical crane 2 is capable of total three dimensional movement with either a constant velocity and no acceleration or a variable velocity with acceleration. Thus, an acceleration detector alone will not reliably detect when a device 3 suspended from the crane 2 is in motion. Accordingly, a local motion detector may be included in each of the crane warning devices 4 which uses any suitable technique to detect motion.

For example, an ultrasonic and/or laser ranging system similar to those employed to focus cameras and/or for target acquisition may be utilized. In one exemplary embodiment, one or more ultrasonic/laser ranging sensors may be mounted to detect the suspended device's relative distance from the boom 5, ground or target level, and/or cab 7. For example, one or more first sensors may be directed towards the boom 5, and one or more second sensors may be directed toward the cab 7 or out-riggers 8 or ground or target level. Further, a plurality of sensors may be located on multiple sides of the suspended device 3 in the event that suspended device 3 twists. In exemplary embodiments, it may be desirable to have two, three, or more motion sensors disposed at spaced locations such that the position of the suspended device 3 and movement of the suspended device 3 may be determined at any time via well known triangulation methods. Any number of motion sensors and/or acceleration sensors may be included in the crane warning devices (e.g., mounted entirely within the suspended device 3) and/or distributed at various locations about the crane 2 and configured to be in electrical and/or electromagnetic communication with the crane warning devices 4 and/or central control device 11.

Where remote sensors are utilized, the remote sensors may be coupled to the crane's movement mechanisms 6 and/or the crane's electronic control system 47, as previously noted. For example, each time that the crane's hydraulic system 51 is actuated a signal may be sent from any one of a number of remote sensors 42A–42E to the crane warning devices 4 (either directly or via the central control device 11) activating a warning. Each of the crane warning devices need not be actuated by the same signals/sensors. For example, the crane warning devices 4A, 4C proximate to the suspended device 3 may be activated whenever cable movement is detected to raise, lower, or swing the cable/boom, whereas the crane warning devices 4*b* proximate to the counter weight 10 may only be activated when the operator initiated a swinging action of the cab 7 such that the counter weight 10 swung left or right. In other words, where multiple crane warning devices 4 are affixed to the crane, each warning device may be under separate control and responsive to some separate sensors and/or some common sensors. Further, the crane warning devices 4 may receive control locally, from the central control device 11, and/or from one or more remote sensors including the camera 12. Similarly, the sensors 12 may send signals to the central control device 11 such that the central control device 11 may control the ascent and/or descent of the suspended device 3 and/or the crane warning devices 4 responsive to the sensors 12.

The crane warning devices 4 may be synchronized such that the audible and/or visual warnings emitted from the devices occur in unison. This eliminates much of the noise distortion of many warning devices occurring at the same time but skewed from each other or operating at a different frequency. Further, the audible warning emitted from the warning device may change depending on the motion of the crane, as previously noted. For example, where the suspended device 3 is moving up, a first audio frequency would be emitted; and when the suspended device 3 is moving down, a second audio frequency would be emitted. Similarly, when the crane 2 is turning left or right, a third audio frequency is emitted, etc. In this manner, regardless of the indication given by the crane operator, the workers would know what motion to expect out of the crane 2 based solely on the noise emitted by the warning device 4. Additionally, it may be desirable to delay movement of the crane 2 for a relatively short period of time (e.g., one, two, or three seconds) while the audible tone sounds. This allows the workers to have, for example, a fraction of a second notice, before movement of the suspended device 3 actually takes place.

As previously noted, the local—remote sensors 12 may also include one or more cameras 12. The cameras 12 may be mounted directly in the crane warning device 4 using, for example, one or more digitally corrected/concatenated wide angle lens, and/or a camera mounted on the boom/carriage to obtain a bird's eye view of the workers and suspended device 3. For the wide angle lenses, digital correction techniques and techniques to concatenate the various image views (e.g., to form a 360 degree view) are well know in the art. Where the cameras 12 are mounted on the carriage and/or boom 5, a manual, fixed, and/or automatic zoom feature may be utilized to improve the visual indication provided to the operator. The visual indication provides the operator with additional information as to the position of the load, suspended device and workers. Where a camera 12 is mounted on the boom 5, the camera 12 may include a fixed and/or adjustable zoom control which enables the operator to view the work up-close. Where the zoom of the camera 12 is under operator control, the control may be via one or more remote switches located in the cab 7, such as on control interface 48. The display from the camera 12 may be shown on display 43.

With some embodiments of the invention the display 43 may be located close to the line of view of the operator out the window in the cab 7 such that the operator may watch the display 43 while still being able to watch the suspended device 3 and associated payload out of the window. For example, the display 43 may be mounted on or near the floor of the cab 7, so that when the crane operator looks through one of the cab windows to view the load when the load is below the crane 2 (such as with a tower crane), the operator can also at the load via the camera 12 view of the load. Alternately, or additionally, the display 43 may be mounted on or near the top of the cab 7, so that when the crane operator looks through one of the cab windows to view the load when the load is above the crane 2 (such as with a smaller crane), the operator can also at the load via the camera 12 view of the load. The display 43 may be any type of display, such as a cathode ray tube display, a plasma display or a liquid crystal display. If the display 43 is, for example, a liquid crystal display, then the display 43 will take up only a minimal amount of space in the cab 7 and will not require additional cooling in the cab 7. Where more than one remote camera 12 is located about the crane, the display 43 may be subdivided into different windows each showing a different camera angle and/or different displays.

The recharging interface 36 operates to recharge the batteries in the cable warning devices 4 periodically. In some embodiments, the cable warning devices 4 incorporate lithium ion batteries which have a high charge density. One or more retractable recharge cables may be coupled from the main body of the crane 2 to the cable warning devices 4 on a periodic basis to recharge the batteries. Alternatively, the batteries may be manually replaceable with or without an option to plug the replaced batteries into a recharging station on the crane body. In the event of a low battery condition, the crane operator will be warned that the battery 23 in one or more of the crane warning devices 4 is low and needs to be recharged and/or replaced. The indication may occur on the display 43.

The audio processor 23 in the crane warning devices 4 allows the operator to communicate with the workers. Where a microphone and speaker system is included in the warning devices 4, the operator can communicate with the workers manipulating the suspended device 3. Conventionally, a worker manipulating the suspended device 3 or load must signal the operator visually with one hand. Modern cranes have the operator enclosed in an environmentally controlled enclosure making voice communication impractical. Accordingly, by including a sophisticated audio processor 23 (e.g., and advanced two-way baby monitor/speaker phone) within the warning devices (such as the one in the suspended device 3 or on the counter weight 10), located on one or more workers (e.g., a two-way radio) and within the cabin 7, the crane operator may have two-way communication with the workers. In this manner, worker safety is vastly increased because the worker may use both hands to manipulate the load while verbally signaling the operator. Where the communication device is located in the suspended device 3 (such as when the crane warning device 4 is positioned in or on the suspended device 3), the communication device also improves over radio communications since neither the operator or the workman have to carry or wear a radio. Further, the speaker and microphone are always present in or on the suspended device 3, further improving safety where, for example, a worker forgets his radio and/or the radio is not working due to low battery power. Further, by building the audible device into the suspended device 3 of the crane, the workers do not have to utilize one hand to operate hand-held radios or other communication devices. Where both a camera 12 and an audio processor 23 are utilized, the combination of theses devices taken together allows the crane operator and the workmen to have two-way communication, as previously discussed. This vastly increases safety and efficiency of the crane operating environment over either device used individually.

As previously noted, one or more of the audio processors 23 may also be included with portable devices carried by individual workmen working in personnel basket or on the ground or target level. For example, a workman may have an audio processor 23 included in a portable unit worn on the workman's belt, wrist, a headset, or contained in helmet 53. Further, these portable audio processors 23 may employ noise canceling capability, in order to assist the workmen in hearing communications from and/or making communications to the crane operator.

The audio processor 23 may be further configured to electronically filter the noise from the crane's audible warning device 22 so as not to interfere with normal communication between the crane operator and the workmen. This electronic filtering is done to filter out the beeping or tones emitted from the warning device without filtering out the normal voice of the operator and/or worker. Where the beeping noise occurs at a predetermined frequency, an electronic filter in the audio processor 23 may be utilized to eliminate or severely attenuate the warning noise such that the operator can easily communicate with the workers. The audio processor 23 may also filter out other distracting noises, such as the noise of the crane's engine. A crane operator often operates with the door of the cab 7 open, so that the operator can hear a shout from a person in personnel basket and/or near the load. Leaving the door open may result in a large interference noise from the exhaust of the crane's engine, however. Accordingly, with various embodiments of the invention, the exhaust of the crane may be positioned away from the crane operator and/or the audio processor 23 may be equipped with noise cancellation technology for canceling interfering noise from the crane's engine.

The verbal communication to each of the warning devices 4 further enhances safety in that the operator has immediate communications with all sides of the crane 2. For example, where another worker notices a safety concern, he can communicate with the operator using any one of the cable warning devices 4.

Communications between the various motion sensors, warning devices 4, and/or central control device 11 may be accomplished using any suitable mechanism such as transmitter/receiver devices 24, 49. For example, as previously discussed, the devices may communicate wirelessly using electromagnetic waves such as radio waves. In some embodiments, a radio frequency in the range of about 900 MHz may be utilized to communicate between the warning device 4 coupled to the suspended device 3 and warning devices 4 coupled to other portions of the crane. Suitable error correction codes, loss of signal detection, and channel hopping may be incorporated into the transmitter/receiver devices 24, 49 to increase safety and reliability. In the event of loss of communications, the warning devices 4 and/or central control device 11 may be programmed to sound an alarm. In still further aspects of the crane warning system according to various embodiments of the invention, fail-safe mechanisms may be built into the crane warning device 4 such that the warning device 4 is activated whenever a sensor 12 fails or loses contact (e.g., radio contact) with the warning device 4. Further, a crane warning device status monitor may be built into the cabin of the crane so that the operator may be warned of any operational problems with any of the sensors 12 in a timely fashion. Further, the operator may be able to determine and/or select a particular microphone/speaker to which to communicate.

In addition to the above, the camera feed may be sent from the camera(s) 12 and/or central control device 11 to two or more locations. For example, the camera feed may be sent to a monitor mounted in the site supervisor's and/or foreman's trailer. Further, the remote feed may be transmitted via a telephone link and/or other link to a remote office such as the construction company's headquarters such that the main company may track the progress of each of its construction projects in real time. In this manner, the site supervisor and/or foreman may be able to monitor the activities of the site to determine work progress and/or worker activity and be alerted to potential safety problems immediately. Further, the central office may be able to centralize ordering and scheduling activities from the main office without having to distribute staff to each of the individual work sites.

Figure 12:
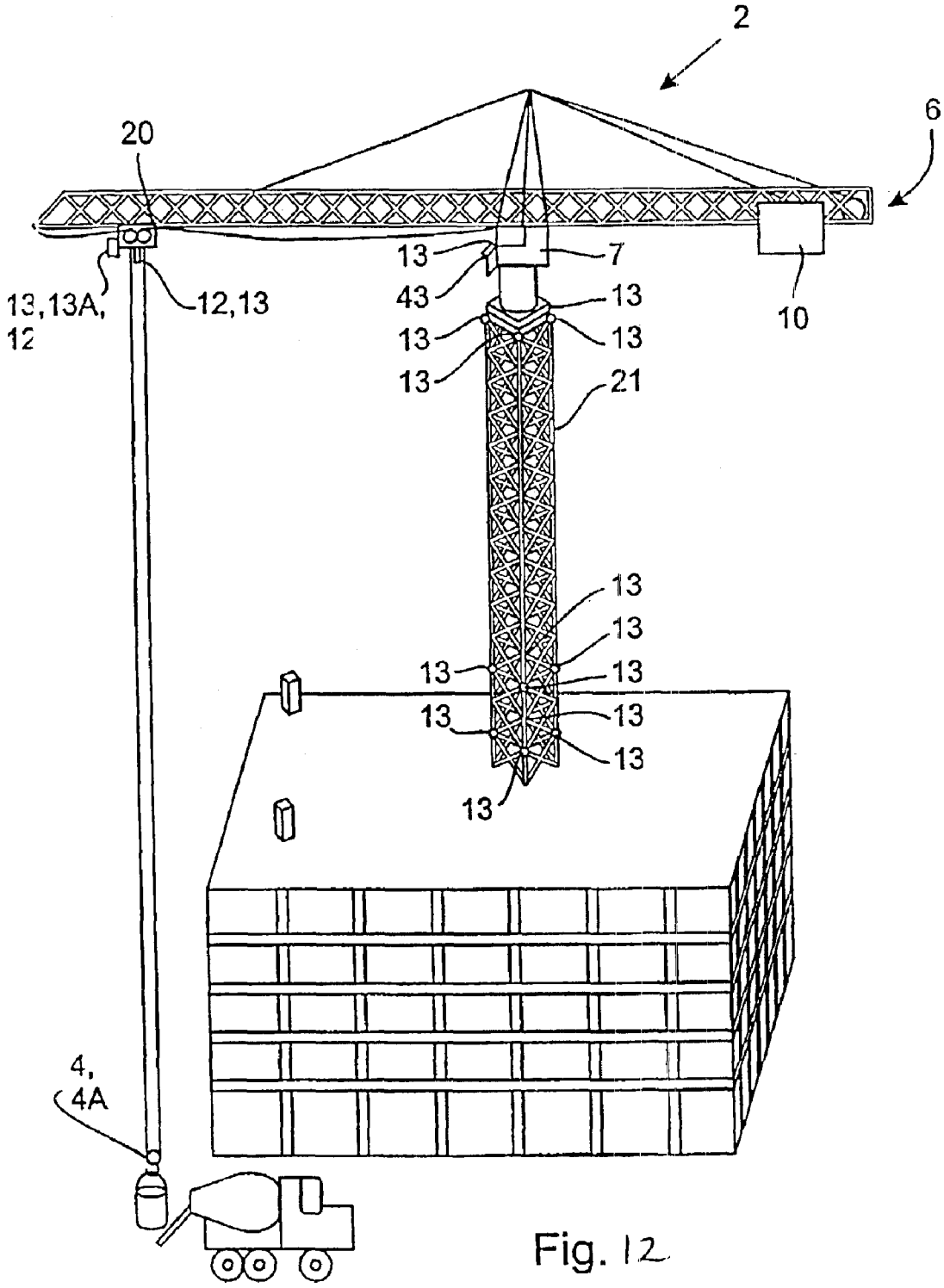
FIG. 12 is a perspective view of second embodiment of a crane incorporating aspects of the invention.

A second exemplary embodiment of the invention is shown in FIG. 12. As shown in this figure, the crane 2 may be a crane commonly utilized to construct tall buildings. The camera 12 may be mounted on the carriage 20. Further, the cameras and/or sensors 12 may also be mounted on the carriage. Additional cameras 12 may be mounted on other locations of the crane 2, such as the cab 7. The camera 12 mounted on the cab 7 may be configured to track the suspended device 3 knowing the location of the carriage (using, for example a laser range finder mounted to the carriage and directed toward the cabin, and/or on the cabin and directed towards the carriage) and the location of the suspended device 3 using a second range finder located on the suspended device 3 and/or on the carriage). In this manner, the camera 12 may be automatically moved to track the current location of the suspended device 3 and zoom in on the work area.

Further, the mounting of the camera 12 on the carriage allows the operator to see around blind ends of the building as the building is constructed such that the crane operator may see areas which would otherwise be obstructed. In this manner, the overall speed, efficiency, and safety of the crane operation is improved. Cameras are known in automated manufacturing environments where cranes are also utilized to transport various components along the manufacturing line. However, the use of remotely mounted cameras 12 on the boom 5, cradle, and/or suspended device 3 of a cantilever type crane has not heretofore been done, particularly in the construction industry. In the construction industry, there is a high incidence of accidents due to common obstructions which block the view of the crane operator and conditions (e.g., surrounding buildings and location of shafts within the building) which prevent the operator in the cab from being able to adequately see and access the area around the suspended device. Further, for very tall buildings, the cranes are often many stories above the work area. Thus, there is a substantial need to address these safety concerns by providing cameras having appropriate angles and mounting locations (particularly as positioned on the boom, cradle, or suspended device or a cantilevered construction crane) to ensure safe operation. The cameras are particularly applicable to construction cranes with cantilevered horizontal booms which extend for 100 feet or more since it is difficult for the operator to see over and around obstructions which typically occur in this environment. Additionally, cameras in accordance with aspects of the invention are particularly applicable to cantilevered booms extending 100 feet or more which are positioned on the ground and utilized to place construction materials or other items used in construction on locations above where a building is being constructed.

As an alternative embodiment, a communication bus such as an Ethernet, fire wire, and/or fiber optic communication path may be disposed along the tower, and/or from the boom to the cab in order to facilitate communications from the various sensors/cameras, the cab, and/or any remote sites (e.g., a trailer).

Accordingly, a crane warning device 4 according to various embodiments of the invention may be used to improve the safety of crane operations, both by alerting workmen or the other persons as to the movement of a crane and by facilitating communication between the crane operator and workmen working with the crane.

Safety Controls

Various embodiments of the invention may additionally or alternately improve the safety of crane operations by employing modified controls for operating the crane itself. For example, with some embodiments of the invention, the crane controls may include an emergency stop button to override all other controls and immediately stop movement of the crane 2 in any direction. This emergency stop button may located only in the cab 7, or it may alternately or additionally also be provided on a remote control handset and/or coupled to a crane warning device 4. Also, with still other embodiments of the invention, a personnel basket may contain a remote control handset that enables an operator in the basket to be remotely coupled to the crane's controls such that the operator in the basket can manipulate the crane 2 to move the basket left to right and/or up and down.

With various embodiments of the invention, the crane controls may also include an alarm to continuously alert a crane operator when the crane 2 is operating beyond a threshold limit. Conventionally, many cranes employ a shutdown system that activates when the crane 2 is carrying more than a safety threshold limit, e.g., 85% of its maximum load. The safety precautions may usually be overridden, however, by simply turning off a control switch, thereby allowing the operator to push beyond the safety threshold limit and go to the maximum extent or even to overextend the crane 2. When this override switch is activated, there is no further warning to the operator that the safety shutoff had been overridden during subsequent operation of the crane.

Figure 13:
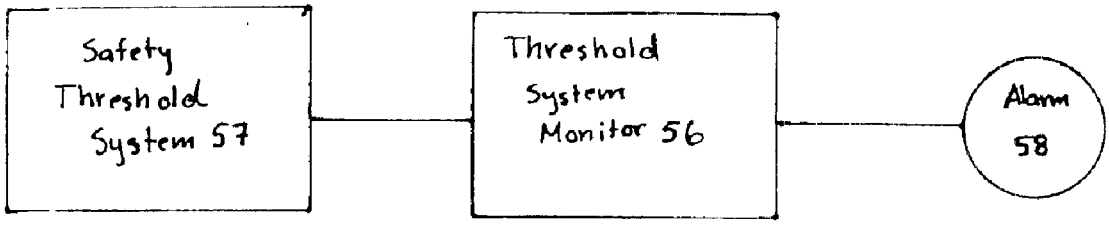
FIG. 13 is a block diagram of a safety threshold warning system according to various embodiments of the invention.

Accordingly, various embodiments of the invention may provide an audible and/or visual warning to the crane operator when the safety controls are overridden. For example, as shown in FIG. 13, a crane 2 may include a threshold system monitor 56 connected to the safety threshold system 57 of the crane 2. When the threshold system monitor 56 detects that the safety threshold system 57 has been overridden, the threshold system monitor 56 actuates an alarm 58. The alarm 58 may be a flashing light and/or audible alarm that actuates to constantly warn the crane operator during the entire period when the safety controls are overridden. With still other embodiments of the invention, the threshold system monitor 56 and alarm 58 may additionally alert the crane operator as to how much the crane's load extends beyond the threshold safety limit. These embodiments may, for example, provide the crane operator with a visual and/or audible warning such as "Caution, Crane at 90% of failure rating!", or display to the operator how much over capacity the crane is using numeric numbers with a caution signal flashing in the cab 7.

Safety Chair

Still other embodiments of the invention provide a chair or other seating device that enhances the safe operation of the crane 2 by allowing the crane operator to maintain proximity to the crane controls at all times. In many cranes, the crane operator has the option of tilting the seat back so that the crane operator can see out of the top window of the cab 7 to observe the load or an operator in a personnel basket. With conventional crane seats, however, the operator often cannot fully reach the hand controls or foot pedals when the seat is tilted back. On some newer cranes, the entire cab structure tilts up, but this feature is very costly. Accordingly, various embodiments of the invention provide a chair for the crane operator that moves or rotates forward and/or down and move the hand controls forward when the chair is tilted back.

Figure 14:
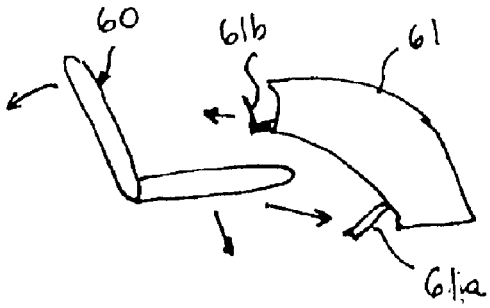
FIG. 14 is a side planar view of a safety chair and control console according to various embodiments of the invention.

For example, as shown in FIG. 14, when the back of the chair 60 it tilted back, the seat moves forward toward a control console 61. Further, the chair 60 may move downward, so that the operator can continue to reach the foot pedals 61*a*. With still other embodiments of the invention, hand controls at the console 61, such as the joy stick controls 61*b*, are moved back toward the chair 60. In this manner, the relative distance between the crane controls and the crane operator are maintained, even when the back of chair 60 is tilted. With still other embodiments of the invention, the controls may be mounted to and/or coupled to arms of the chair 60, so that the controls tilt back with the chair 60 to maintain the crane so operator's elbow/hands at a constant distance/relation to the controls.

Safety Rotational Control Device

Yet other embodiments of the invention provide a device for controlling rotation of a ball 9*a* (or other device or load maintaining tension on the chain or cable,). Referring now to FIG. 14, conventional balls 9*a* typically have a first portion 64 and a second portion 65. The first portion 64 is connected to the chain or cable 66, so that it does not rotate. The second portion 65, however, can rotate about the axis of the ball 9*a*. In some situations, free rotation is undesirable. For example, allowing the lower portion 65 to spin freely is dangerous when the crane 2 is suspending a personnel basket from the ball 9*a*, in that the basket can spin into a building in high winds. Workmen working with the ball 9*a* cannot dynamically lock the ball 9*a* to keep the portion 65 from optionally spinning, however, and permanently locking the lower portion 65 of the ball 9*a* from freely rotating is also undesirable.

Figure 15:
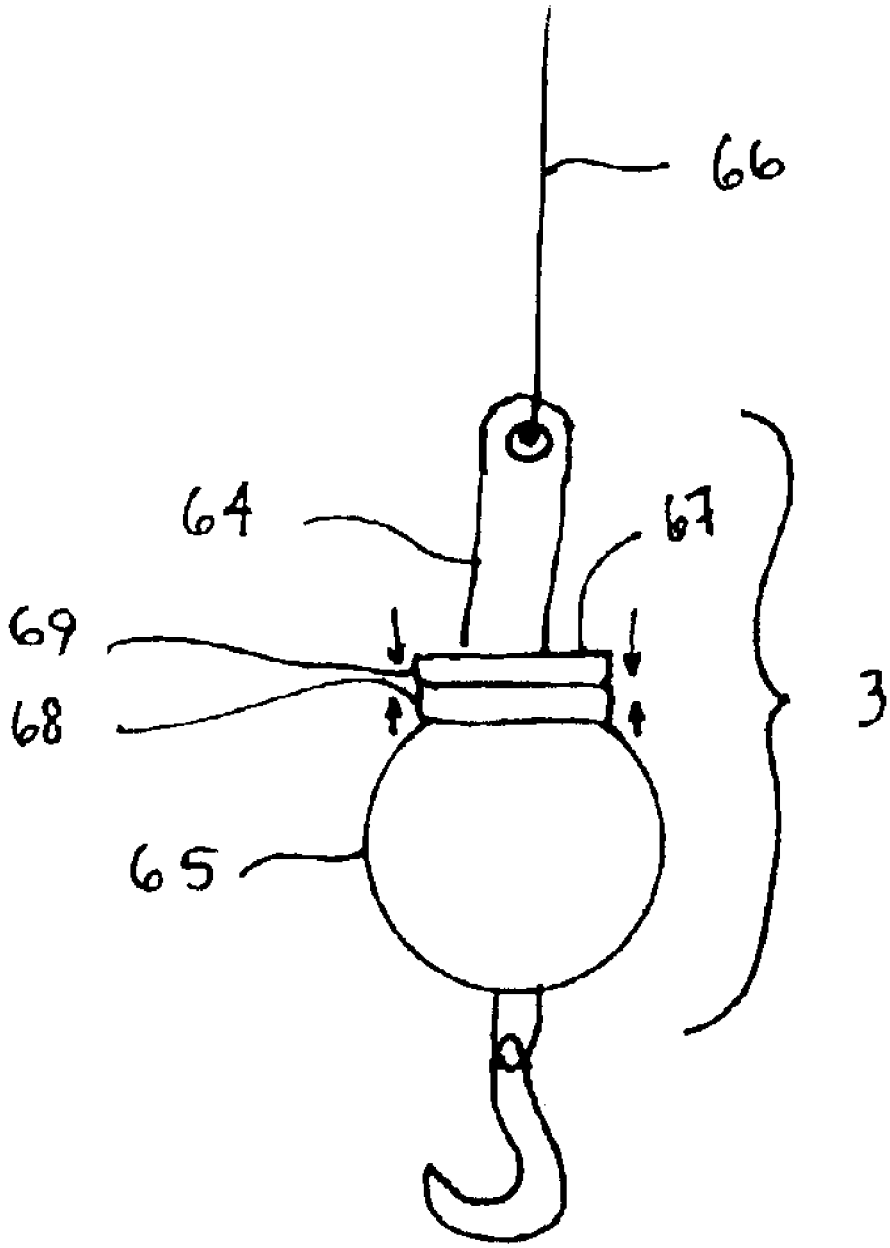
FIG. 15 is planar view of a braking and locking mechanism according to various embodiments of the invention.

Accordingly, various embodiments of the invention providing a braking, locking and unbraking mechanism for slowing or stopping rotation of the lower portion 65 of the ball 9*a* relative to the upper portion 4. For example, as shown in FIG. 15, a ball 9*a* may include a braking mechanism 67 including a lower braking unit 68 and an upper braking unit 69. When the mechanism 67 is actuated, at least one of the braking units 68 and 69 moves to contact the other so as to brake free rotation of the lower portion 65 of the ball 9*a*. With still further embodiments of the invention, the ball 9*a* may alternately or additionally include a motor for actively rotating the lower portion 65 of the ball 9*a*. These embodiments may be particularly useful for precisely placing a load in critical areas, such as when the outside sheathing of a building is being placed. With various embodiments of the invention, the braking mechanism and/or motor may be remotely controlled by the crane operator, workmen working in a personnel basket, workmen working on the ground or at a target level, or any combination of the three. Of course, while the braking mechanism 67 has been described for use with a ball 9*a*, it should be appreciated that the braking mechanism 67 (or other braking mechanism or rotation control motor) may be used with any suspended device 3 that might otherwise allow undesired free rotation.

Conclusion

While an exemplary crane warning devices embodying one or more aspects of the present invention are shown, it will be understood, of course, that the invention is not limited to these embodiments. Modifications may be made by those skilled in the art, particularly in light of the foregoing teachings. It is, therefore, intended that the appended claims cover any such modifications which incorporate the features of this invention or encompass the true spirit and scope of the invention. For example, each of the elements and/or steps of the aforementioned embodiments may be utilized alone or in combination with other elements and/or steps from other embodiments. For example, it is specifically contemplated by the inventor that any one of the following may be claimed either alone or in combination with one or more of the other elements below:

1. Camera mounted on carriage;
2. Camera mounted on suspended device,
3. One or more cameras mounted on cab;
4. One or more cameras mounted on a cantilevered boom of a construction crane;
5. One or more cameras mounted on tower,
6. One or more cameras mounted on counterweight;
7. One or more cameras mounted about the cab (e.g., in a 360 degree view);
8. One or more cameras mounted about the tower (e.g., in a 360 degree view);
9. One or more cameras mounted about the tower (e.g., in a 360 degree view) in multiple vertical locations showing a 360 degree horizontal view (about 90 degrees per camera);
10. Zoom camera mounted on any of the above;
11. Manually controlled zoom camera mounted on any of the above with controls located in the cab;
12. Automatically controlled zoom camera mounted on any of the above;
13. Wide angle camera mounted on any of above;
14. Camera mounted on any of the above with display in the cab;
15. Camera mounted on at least two of the above locations with multiple displays in the cab;
16. Camera permanently mounted on at least two of the above with multiple display windows on a single display in the cab;
17. Camera mounted on any of the above with the feed going to a display located in a remote location such as a trailer,
18. One or more cameras mounted on any of the above with a feed going to a display located at a remote location such as the construction company's headquarters;
19. Sensor (e.g., range finder) mounted on carriage, cab, tower, suspended device, boom and/or cable;
20. Sensor readings displayed in cab;
21. Sensor readings used to control assent and/or descent of suspended device;
22. Sensor readings used to increase acceleration and/or deceleration while suspended device is not close to target or boom;
23. Sensor used to determine zoom of camera and/or manual zoom of camera controlled by operator;
24. Sensor used to determine where the camera is controlled to point;
25. Sensor used to determine a relative distance between the suspended device and target (e.g. floor or ground location);
26. Sensor used to determine when the warning device is to be activated responsive to movement of the suspended device;
27. Acceleration sensor used to determine activation of warning device;
28. Motion sensor used to determine activation of warning device;
29. Hydraulic sensor used to determine activation of warning device;
30. Sensor coupled to warning device via electromagnetic waves;
31. Sensor coupled to control system of crane;
32. Crane warning device coupled to central control device via electromagnetic waves;
33. Warning device emitting a modified signal based on sensor output;
34. Warning device emitting a different signal on assent than on decent;

35. A device suspended from crane including a crane warning device;
36. A device suspended from crane including a flashing and/or strobe light;
37. A device suspended from crane including an audible beeper,
38. A crane warning device visible from all sides;
39. Display of camera feed located about cab;
40. Display of camera feed located in a line of sight where the operator can see both the display and the suspended device out the window of the cab;
41. A plurality of camera displays located about the cab;
42. A plurality of camera images being displayed on a single display in windows;
43. Display of the camera feed in a remote location such as in the site foreman's or site supervisor's cabin;
44. Display of the camera feed in both a remote location and in the cab;
45. Speech processor located in a device suspended from a crane;
46. Speech processor located about cable above a suspended device;
47. Microphone located in a device suspended from a crane;
48. Microphone located about cable above a device suspended from a crane;
49. Speaker phone located in a device suspended from a crane and communicating with cab;
50. Speaker phone being located on a workmen working in vicinity of a device suspended from a crane and communicating with cab;
51. Speaker phone located in vicinity of a device suspended from a crane having a digital filter to filter out noise of warning device;
52. Microphone and speaker being mounted in cab and in a device suspended from a crane allowing two way communication between cab and workers in the vicinity of the suspended device;
53. A crane having a plurality of distributed crane warning devices;
54. A plurality of distributed crane warning devices emitting a beeping noise while the crane is in motion;
55. A plurality of distributed crane warning devices, each being coupled to a different sensor to emit a warning signal responsive to different events (e.g., movement of suspended device, movement of counter weight);
56. A plurality of crane warning devices emitting a synchronized warning signal;
57. A crane warning device including a microphone and speaker;
58. A crane warning device including a camera;
59. A plurality of crane warning devices communicating with a central control device;
60. A crane comprising a crane, boom and suspended device, with a camera mounted on the boom directed at the suspended device;
61. A crane comprising a crane, boom, carriage, and suspended device, with a camera mounted on the carriage facing the suspended device;
62. A crane having an warning device mounted on a counter weight;
63. Varying a signal emitted by an electronic warning indicator responsive to the type of motion being initiated by a a device suspended from a crane;
64. Emitting a signal from an electronic warning indicator just prior to actually initiating the movement;
65. A method comprising having two crane warning devices communicating with each other,
66. A method comprising employing a plurality of remotely mounted crane suspended device movement warning sensors communicating with a central control device;
67. Locating an antenna within an open enclosure of a device suspended from a crane;
68. Locating a light within an open enclosure of a device suspended from a crane;
69. A light with a colored protective cover within an open enclosure of a device suspended from a crane;
70. Locating a flashing light within a open enclosure of a device suspended from a crane;
71. Locating multiple speakers (e.g., each facing a different direction) within a a device suspended from a crane;
72. Locating a crane warning device such that it surrounds a cable in a location proximate to a device suspended from a crane;
73. Disposing batteries within a device suspended from a crane;
74. Disposing a removable battery pack within a device suspended from a crane;
75. Disposing batteries with a recharging interface in a device suspended from a crane;
76. Locating a battery recharging station on a crane;
77. Locating a battery in a crane warning device;
78. Disposing a communication link along the tower (e.g., an Ethernet connection);
79. Disposing a communication link along the boom (e.g., an Ethernet connection);
80. Using a communication link to communicate between the cab and a remote sensor and/or camera;
81. Using a communication link to communicate between the cab (e.g., central control device) and a remote site such as a trailer and/or a central office;
82. Disposing failure mode detectors within the warning devices to give the crane operator an indication when one or more of the crane warning devices is inoperable;
83. Having a test loop where the speaker emits a predetermined tone which is thereafter detected by the microphone in the crane warning device to have a periodic self test;
84. Output of sensor shown over display in cab as an overlay;
85. A device suspended from a crane with an open enclosure;
86. A device suspended from a crane with an open enclosure having a camera disposed therein;
87. A signal processing device including an electronic filter for reducing the level of beeps heard by an operator in a cab relative to voice input to a microphone in a device suspended from a crane;
88. Display in the cab (e.g., an overlay on display) showing distance to target or floor, distance of a suspended device from floor or boom, distance of carriage from cab along boom;
89. A central control device including a memory, a controller, and a signal processor located in an arrangement supported by the tower and controlling any one of the above;
90. A central control device including an antenna for remotely communicating with at least one crane warning device;
91. Mounting a range finder (e.g., a laser range finder) on a device suspended from a crane;
92. Mounting a range finder (e.g., a laser range finder) on a cab of a crane;
93. Mounting a range finder (e.g., a laser range finder) on a carriage of a crane;
94. Mounting a range finder (e.g., a laser range finder) on a carriage of a crane pointing at a device suspended from the crane;

95. Mounting a range finder (e.g., a laser range finder) on a carriage of a crane pointing at a target (floor) which lies below a device suspended from the crane and any associated payload;
96. Mounting a range finder (e.g., a laser range finder) on a boom of a crane;
97. Mounting a sensor on hydraulics of a crane to detect motion;
98. Coupling a sensor to a movement mechanism of a crane to detect motion;
99. Using a laser range finder on a crane;
100. Using an acceleration detector on a crane.

Additionally, one or more of the above elements may be combined with another element, method, or technique shown in the drawings or described in the specification. For example, one or more of the above elements may be utilized on a cantilevered construction crane having a boom length of at least 80 feet and even more desirable for those cantilevered construction cranes having a total boom length in excess of 100 feet.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A crane safety device, comprising:

a motion detector for detecting motion of a device suspended from a crane;

an alarm that generates a visible or audible warning signal in response to the motion detector detecting motion of the suspended device; and a control for controlling the warning signal.

2. The crane safety device recited in claim 1, wherein the control is located for operation by a crane operator working in a cab of the crane.

3. The crane safety device recited in claim 1, wherein the control is remote from the crane.

4. The crane safety device recited in claim 1, wherein activation of the control discontinues the warning signal.

5. The crane safety device recited in claim 1, wherein the warning signal is an audible warning signal, and the control changes a volume of the audible warning signal.

6. The crane safety device recited in claim 5, further comprising:

a communication device for communication between a crane operator in a cab of the crane and workmen remote from the cab of the crane, and wherein the control activates in response to a transmission by the communication device.

7. The crane safety device recited in claim 1, wherein activation of the control is automatically discontinued after a predetermined period of time.

8. The crane safety device recited in claim 1, wherein the control activates in response to the warning signal continuing beyond a predetermined period of time.

9. The crane safety device recited in claim 1, further comprising:

a detector for detecting a distance between the suspended device and a target level, and wherein the warning signal changes in response to the detector detecting that the suspended device has moved to within a predetermined distance from the target level.

* * * * *